US010054893B2

(12) United States Patent
Kotani

(10) Patent No.: US 10,054,893 B2
(45) Date of Patent: Aug. 21, 2018

(54) RECORDING MEDIUM EJECTING DEVICE AND IMAGE FORMING APPARATUS

(71) Applicant: KYOCERA Document Solutions Inc., Osaka (JP)

(72) Inventor: Takashi Kotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/089,643

(22) Filed: Apr. 4, 2016

(65) Prior Publication Data

US 2016/0299464 A1 Oct. 13, 2016

(30) Foreign Application Priority Data

Apr. 8, 2015 (JP) ..... 2015-079154

(51) Int. Cl.
*B65H 29/58* (2006.01)
*G03G 15/00* (2006.01)
(Continued)

(52) U.S. Cl.
CPC ..... *G03G 15/6552* (2013.01); *B65H 29/58* (2013.01); *B65H 31/24* (2013.01);
(Continued)

(58) Field of Classification Search
CPC ..... B65H 2301/4217; B65H 2408/11; B65H 2408/111; B65H 2408/112; B65H 29/60;
(Continued)

(56) References Cited

U.S. PATENT DOCUMENTS 4,015,841 A * 4/1977 Mitsumasu ..... B65H 29/60 270/58.18
4,193,312 A * 3/1980 Cicognani ..... F16G 5/00 474/242
(Continued)

FOREIGN PATENT DOCUMENTS

JP H02286506 A 11/1990
JP H04210142 A 7/1992
(Continued)

OTHER PUBLICATIONS

An Office Action; "Notice of Reasons for Rejection," mailed by the Japanese Patent Office dated Nov. 21, 2017, which corresponds to Japanese Patent Application No. 2015-079154 and is related to U.S. Appl. No. 15/089,643.
(Continued)

*Primary Examiner* — Thomas A Morrison
(74) *Attorney, Agent, or Firm* — Studebaker & Brackett PC

(57) ABSTRACT

A recording medium ejecting device includes ejecting trays, a guiding member and a switching mechanism. The guiding member is switchable between a first posture to permit ejection of a recording medium on one ejecting tray and a second posture to restrict the ejection of the recording medium on the one ejecting tray. The switching mechanism switches the guiding member between the first posture and the second posture. The switching mechanism includes pulleys, a driving belt and a pressing member. The driving belt is wound around the pulleys. The pressing member presses the guiding member. The driving belt includes a contactable area configured to be contactable with each of the pulleys and a contact restricted area whose contact with each of the pulleys is restricted. The pressing member
(Continued)

catches the contact restricted area from both an outer face side and an inner face side.

6 Claims, 12 Drawing Sheets

(51) Int. Cl.
*B65H 31/24* (2006.01)
*B65H 39/11* (2006.01)

(52) U.S. Cl.
CPC ..... *B65H 39/11* (2013.01); *B65H 2403/21* (2013.01); *B65H 2403/51* (2013.01); *B65H 2404/632* (2013.01); *B65H 2405/332* (2013.01); *B65H 2408/111* (2013.01); *B65H 2801/06* (2013.01)

(58) Field of Classification Search
CPC .... B65H 31/24; B65H 2404/63; B65H 29/58; G03G 15/6552
USPC ..... 271/279, 280, 296, 297, 300, 303, 305
See application file for complete search history.

(56) References Cited

U.S. PATENT DOCUMENTS

| | | | | |
|---|---|---|---|---|
| 6,334,611 | B1 * | 1/2002 | Koo | B65H 39/11 270/58.18 |
| 7,976,021 | B2 * | 7/2011 | Matsuo | B65H 29/58 271/297 |
| 2010/0001462 | A1 | 1/2010 | Matsuo | |

FOREIGN PATENT DOCUMENTS

| | | | |
|---|---|---|---|
| JP | 2005-075488 | A | 3/2005 |
| JP | 2010-013249 | A | 1/2010 |

OTHER PUBLICATIONS

An Office Action issued by Chinese Patent Office dated Dec. 25, 2017, which corresponds to Chinese Patent Application No. 201610186654.7 and is related to U.S. Appl. No. 15/089,643; with its English translation.

* cited by examiner

RECORDING MEDIUM EJECTING DEVICE AND IMAGE FORMING APPARATUS

INCORPORATION BY REFERENCE

This application is based on and claims the benefit of priority from Japanese Patent application No. 2015-079154 filed on Apr. 8, 2015, the entire contents of which are incorporated herein by reference.

BACKGROUND

The present disclosure relates to a recording medium ejecting device including a plurality of ejecting trays on which a recording medium is ejected and an image forming apparatus including the recording medium ejecting device.

Conventionally, a recording medium ejecting device arranged at an electrographic image forming apparatus is known.

For example, there is a recording medium ejecting device including a plurality of ejecting trays on which a recording medium is ejected, a guiding member configured to be switchable between a posture to permit ejection of the recording medium on one ejecting tray of a plurality of the ejecting trays and another posture to restrict the ejection of the recording medium on the one ejecting tray, and a switching mechanism configured to switch the posture of the guiding member. The above-mentioned switching mechanism includes a plurality of pulleys, a driving belt wound around a plurality of the pulleys, and a pressing member configured to move in accordance with running of the driving belt and to press the guiding member.

With regard to the recording medium ejecting device with the above-mentioned configuration, if the pressing member is fixed to the driving belt with a state that a part of the pressing member goes into an inner face side of the driving belt, each pulley and the pressing member interfere with each other when the pressing member passes an area corresponding to each pulley, so that it becomes difficult to make the driving belt run. Therefore, normally, the pressing member is integrally molded on the outer face of the driving belt.

SUMMARY

In accordance with an embodiment of the present disclosure, a recording medium ejecting device includes a plurality of ejecting trays, a guiding member and a switching mechanism. On a plurality of the ejecting trays, a recording medium is ejected. The guiding member is configured to be switchable between a first posture to permit ejection of the recording medium on one ejecting tray of a plurality of the ejecting trays and a second posture to restrict the ejection of the recording medium on the one ejecting tray. The switching mechanism is configured to switch the guiding member between the first posture and the second posture. The switching mechanism includes a plurality of pulleys, a driving belt and a pressing member. The driving belt is wound around a plurality of the pulleys. The pressing member is configured to move in accordance with running of the driving belt and to press the guiding member. The driving belt includes a contactable area configured to be contactable with each of the pulleys and a contact restricted area whose contact with each of the pulleys is restricted. The pressing member is fixed to the driving belt in a state that the pressing member catches the contact restricted area from both an outer face side and an inner face side.

In accordance with an embodiment of the present disclosure, an image forming apparatus includes the above-mentioned recording medium ejecting device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
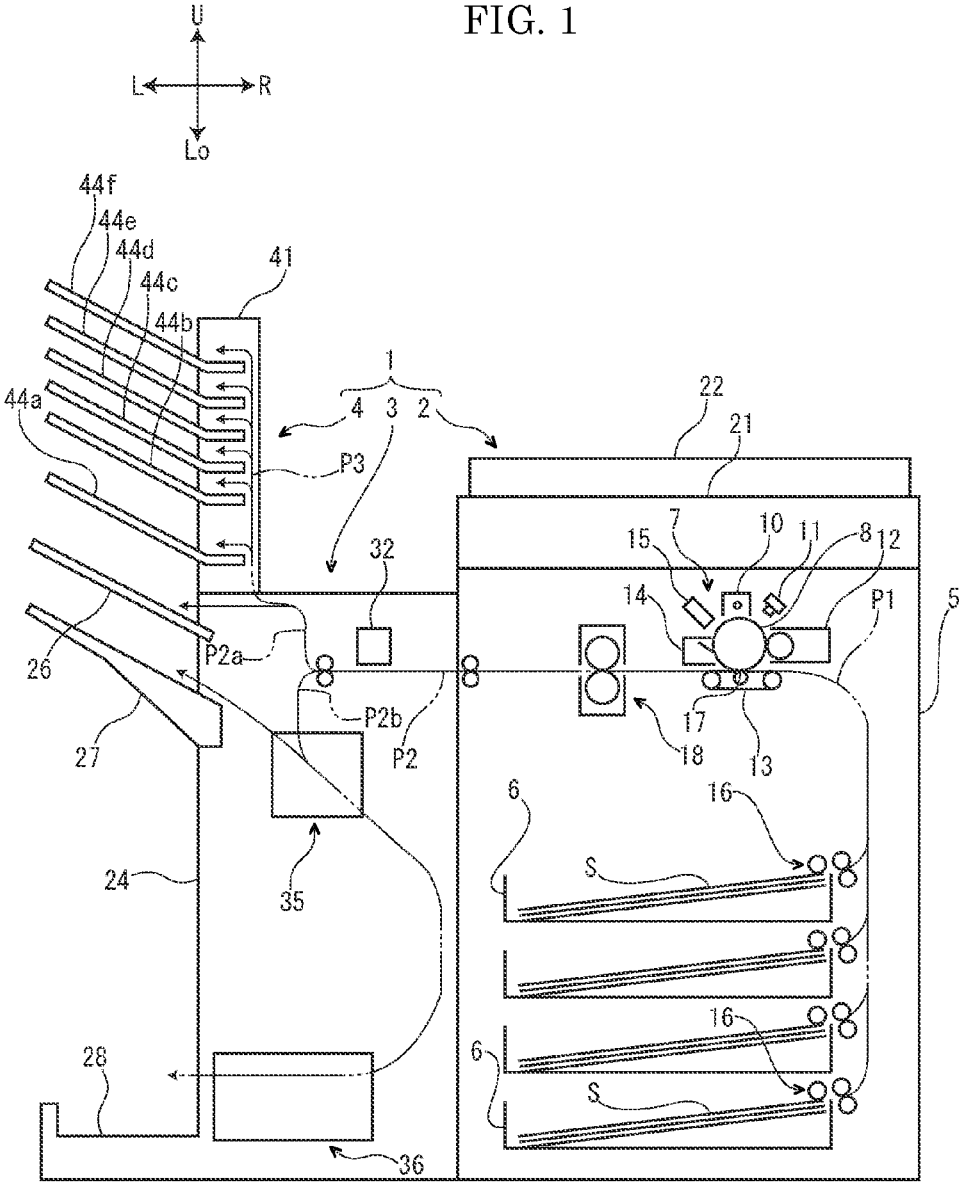
FIG. 1 is a schematic view showing an outline of an image forming apparatus according to a first embodiment of the present disclosure.

Hereinafter, an image forming apparatus 1 according to the first embodiment of the present disclosure will be described with reference to the drawings. For ease of description, a front side in FIG. 1 is defined as a front side (front face side) of the image forming apparatus 1. Arrows Fr, Rr, L, R, U and Lo optionally added to each drawing indicate a front side, a rear side, a left side, a right side, an upper side and a lower side of the image forming apparatus 1, respectively.

As shown in FIG. 1, the image forming apparatus 1 includes a multifunction peripheral 2 (hereinafter, MFP 2) as an image forming device, a post-processing device 3 which is positioned at a left side of the MFP 2, and a sheet ejecting device 4 (recording medium ejecting device) which is positioned above the post-processing device 3.

Firstly, a configuration of the MFP 2 will be described.

As shown in FIG. 1, the MFP 2 includes a box-shaped MFP main body 5. At a lower part of the MFP main body 5, a plurality of sheet feeding cassettes 6 are accommodated. In each sheet feeding cassette 6, sheets S (recording media) are accommodated.

At an upper part of the MFP main body 5, an image forming part 7 is arranged. The image forming part 7 includes a photosensitive drum 8 (image carrier), a charger 10, an exposure device 11, a developing device 12, a transferring device 13, a cleaning device 14 and a discharger 15.

Inside the MFP main body 5, a first conveying path P1 for conveying the sheets S is arranged. At an upstream end part of the first conveying path P1, a plurality of sheet feeding units 16 are arranged at an upper right side of each sheet feeding cassette 6. At a midstream part of the first conveying path P1, a transferring part 17 is arranged between the photosensitive drum 8 and the transferring device 13. At a downstream part of the first conveying path P1, a fixing device 18 is arranged.

At an upper end part of the MFP main body 5, an image reading device 21 which reads document images is arranged. Above the image reading device 21, an automatic document conveying device 22 which automatically conveys a document to the image reading device 21 is arranged.

Next, an operation of the MFP 2 will be described.

When an instruction to start printing is given to the MFP 2, the charger 10 first charges a surface of the photosensitive drum 8. Next, the photosensitive drum 8 is exposed by laser light from the exposure device 11 according to image data so as to form an electrostatic latent image on the photosensitive drum 8. Next, this electrostatic latent image is developed to a toner image by the developing device 12. Incidentally, a toner and electric charges remaining on the photosensitive drum 8 are removed by the cleaning device 14 and the discharger 15.

Meanwhile, each sheet S taken from each sheet feeding cassette 6 by each sheet feeding unit 16 is conveyed in the first conveying path P1 toward a downstream side, and enters the transferring part 17. In this transferring part 17, the toner image on the photosensitive drum 8 is transferred to each sheet S. Each sheet S on which the toner image has been transferred is further conveyed in the first conveying path P1 toward the downstream side, and enters the fixing device 18. In this fixing device 18, the toner image is fixed onto each sheet S. Each sheet S onto which the toner image has been fixed is ejected from a downstream end part of the first conveying path P1 to the post-processing device 3.

Next, a configuration of the post-processing device 3 will be described.

As shown in FIG. 1, the post-processing device 3 includes a casing 24. In a left face of the casing 24, a first upper tray 26, a second upper tray 27 and a lower tray 28 are protruded in order from upper side.

Inside the casing 24, a second conveying path P2 for conveying the sheets S is arranged. An upstream end part of the second conveying path P2 is connected to the downstream end part of the first conveying path P1 of the MFP 2. At an upstream part of the second conveying path P2, a punching device 32 is arranged. The second conveying path P2 is branched into an upper conveying path P2*a* and a lower conveying path P2*b* at a position closer to a downstream side than the punching device 32. At an upstream part of the lower conveying path P2*b*, a staple device 35 is arranged, and, at a downstream part of the lower conveying path P2*b*, a sheet folding device 36 is arranged.

Next, an operation of the post-processing device 3 will be described.

The sheets S ejected from the downstream end part of the first conveying path P1 of the MFP 2 enter the upstream end part of the second conveying path P2 of the post-processing device 3. Then, the sheets S are subjected to a punching process by the punching device 32 if necessary and then sorted to the upper conveying path P2*a* or the lower conveying path P2*b*. A part of the sheets S sorted to the upper conveying path P2*a* are ejected to the sheet ejecting device 4, and another part of the sheets S sorted to the upper conveying path P2*a* are ejected on the first upper tray 26. A part of the sheets S sorted to the lower conveying path P2*b* are subjected to a staple process by the staple device 35 if necessary, and then are ejected on the second upper tray 27. Another part of the sheets S sorted to the lower conveying path P2*b* are subjected to the staple process by the staple device 35 and a folding process by the sheet folding device 36 if necessary, and are ejected on the lower tray 28.

Next, a configuration of the sheet ejecting device 4 will be described.

Figure 2:
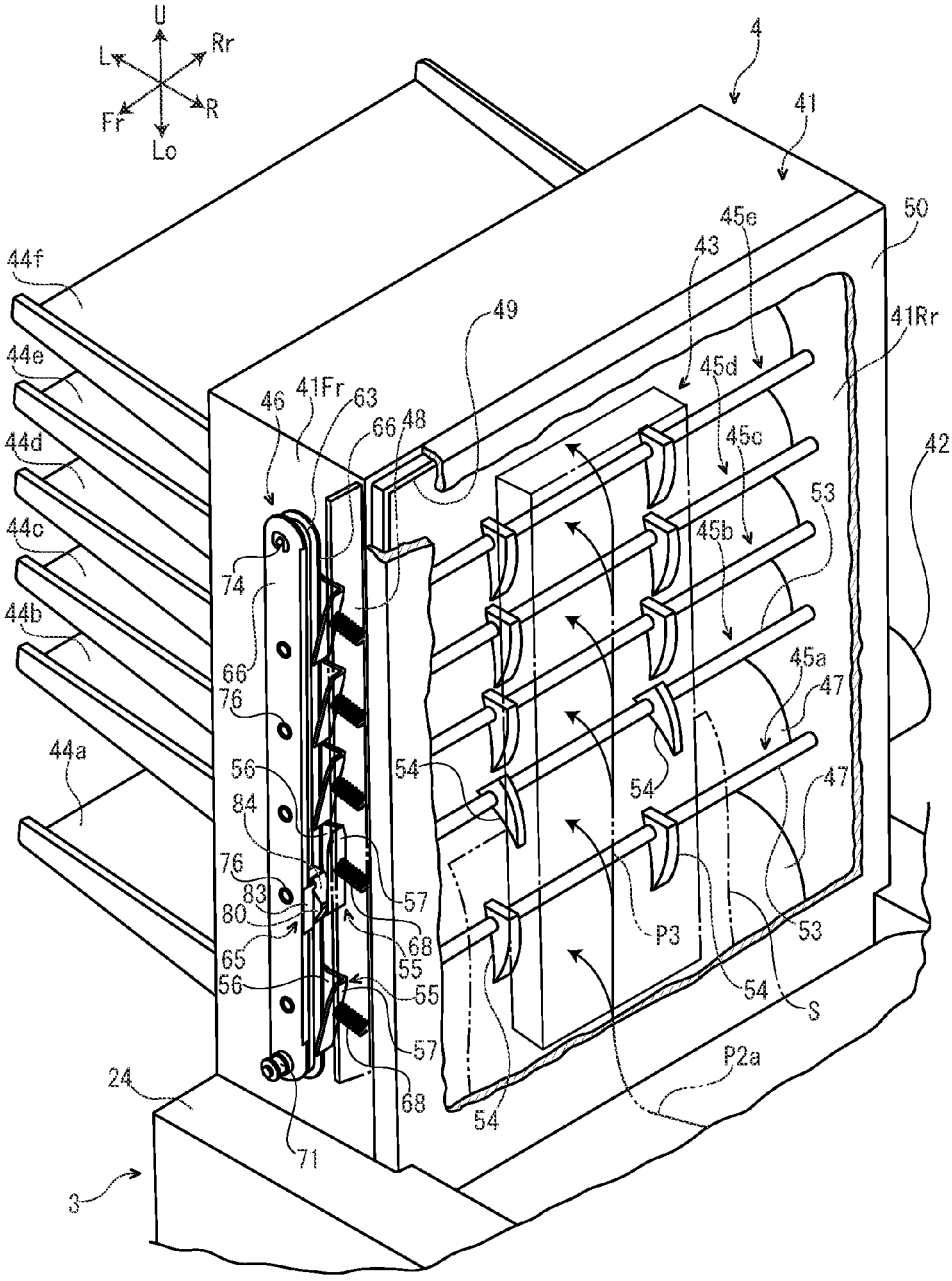
FIG. 2 is a perspective view showing a state where a sheet is ejected on a second ejecting tray in a sheet ejecting device according to the first embodiment of the present disclosure.

As shown in FIG. 1, the sheet ejecting device 4 is coupled to the MFP 2 via the post-processing device 3. As shown in FIG. 2, the sheet ejecting device 4 includes a housing 41, a driving motor 42 (driving source) which is positioned at a lower back side of the housing 41, a conveying mechanism 43 which is accommodated at a right end part of the housing 41, first to sixth ejecting trays 44*a* to 44*f* which protrude leftward from the housing 41, first to fifth guiding members 45*a* to 45*e* which are accommodated at a right part of the housing 41, and a switching mechanism 46 which is positioned at a front side of the housing 41.

The housing 41 is formed in a cuboid shape and flat in a left and right direction. Inside the housing 41, a third conveying path P3 for conveying the sheets S is arranged along an upper and lower direction. A lower end part (upstream end part) of the third conveying path P3 is connected to a downstream end part of the upper conveying path P2*a* of the post-processing device 3. Inside the housing 41, a plurality of (six in the present embodiment) guiding plates 47 are arranged at intervals in the upper and lower direction. At a right end part of a front plate 41*Fr* of the housing 41, a contact plate 48 is protruded forward. In a right face of the housing 41, an opening part 49 is formed, and the opening part 49 is covered with an openable cover 50. Incidentally, in FIG. 2, the cover 50 is shown with a cutout state.

The driving motor 42 is arranged at a rear face side (outer face side) of a rear plate 41*Rr* of the housing 41. The driving motor 42 is composed of a stepping motor, for example, and is arranged to be able to rotate normally and reversely.

The conveying mechanism 43 has a function of conveying the sheets S from a lower side to an upper side along the third conveying path P3. The conveying mechanism 43 is connected to the driving motor 42 via a first one-way clutch (not shown).

The first to sixth ejecting trays 44*a* to 44*f* are arranged in a row at intervals in the upper and lower direction. The first to sixth ejecting trays 44*a* to 44*f* are positioned in order of the first ejecting tray 44*a*, the second ejecting tray 44*b*, the third ejecting tray 44*c*, the fourth ejecting tray 44*d*, the fifth ejecting tray 44*e* and the sixth ejecting tray 44*f* from the lower side (at an upstream side in a conveying direction of the sheets S) to the upper side (the downstream side in the conveying direction of the sheets S). A positioning interval between the first ejecting tray 44*a* and the second ejecting tray 44*b* is wider than positioning intervals between the ejecting trays 44*b* to 44*f* other than the first ejecting tray 44*a* (e.g. the positioning interval between the second ejecting tray 44*b* and the third ejecting tray 44*c*).

Each ejecting tray 44*a* to 44*f* is connected to the third conveying path P3 via each guiding plate 47 arranged inside the housing 41 so that the sheets S conveyed along the third conveying path P3 are eject on each ejecting tray 44*a* to 44*f* via each guiding plate 47.

The first to fifth guiding members 45*a* to 45*e* are arranged at intervals in the upper and lower direction. The first to fifth guiding members 45*a* to 45*e* are positioned in order of the first guiding member 45*a*, the second guiding member 45*b*, the third guiding member 45*c*, the fourth guiding member 45*d* and the fifth guiding member 45*e* from the lower side (the upstream side in the conveying direction of the sheets S) to the upper side (the downstream side in the conveying direction of the sheets S).

Each guiding member 45*a* to 45*e* includes a guiding shaft 53 which is elongated in a front and rear direction, multiple guiding pieces 54 (only two guiding pieces 54 are shown in FIG. 2) which are fixed to a portion from a front part to a rear part of the guiding shaft 53, and a pressed piece 55 which is fixed to a front end part of the guiding shaft 53. The guiding shaft 53 is installed between the front plate 41*Fr* and the rear plate 41*Rr* of the housing 41, and is swingably supported by the housing 41. Each guiding piece 54 faces the third conveying path P3 inside the housing 41. The pressed piece 55 is positioned at a front face side (outer face side) of the front plate 41*Fr* of the housing 41. The pressed piece 55 includes a base plate 56 which is fixed to the front end part of the guiding shaft 53, and a bent plate 57 which is bent forward from a right end part of the base plate 56.

Each guiding member 45*a* to 45*e* is arranged so as to be switchable between a first posture (a posture of the second guiding member 45*b* in FIG. 2) and a second posture (postures of the first guiding member 45*a* and the third to fifth guiding members 45*c* to 45*e* in FIG. 2).

Figure 3:
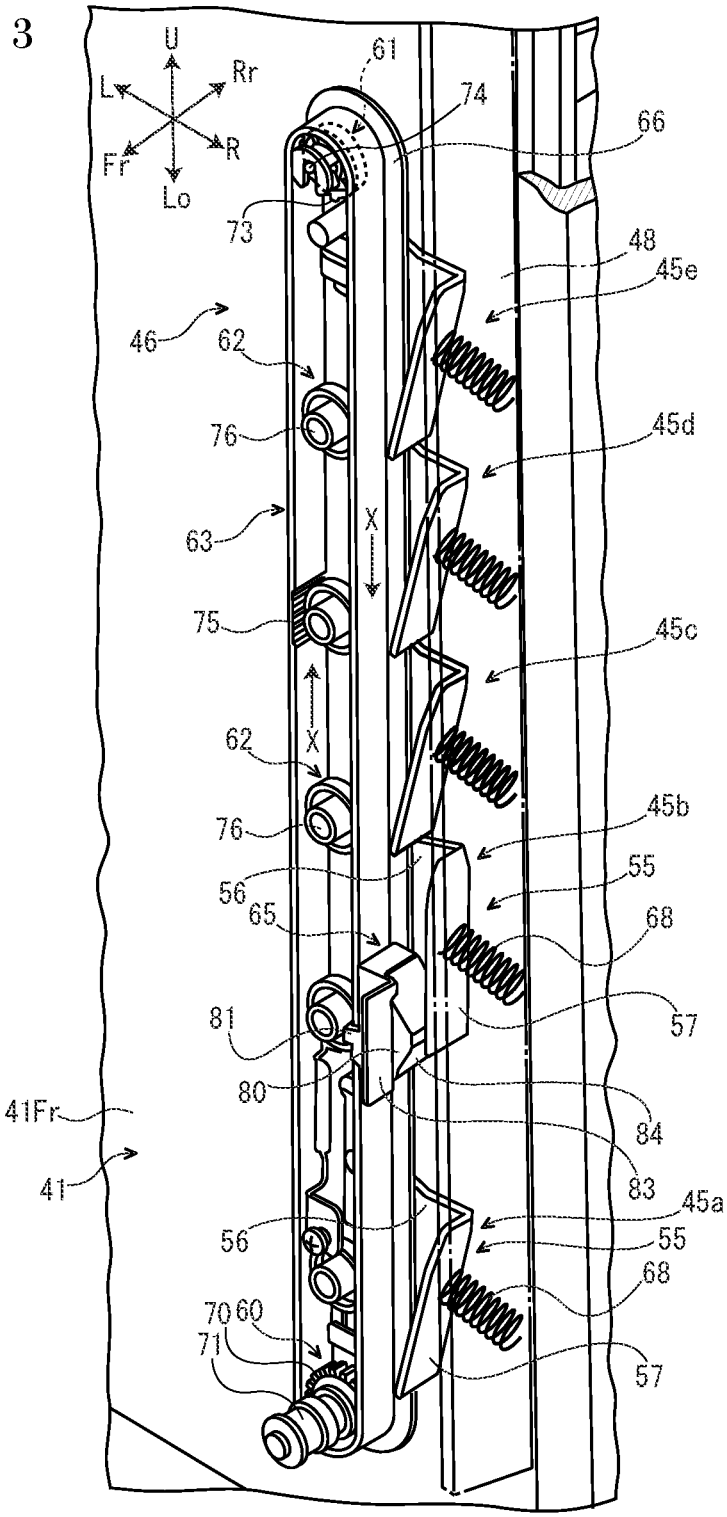
FIG. 3 is a perspective view showing a switching mechanism and its periphery in a sheet ejecting device according to the first embodiment of the present disclosure.

As shown in FIG. 3, the switching mechanism 46 is positioned at the front face side (outer face side) of the front plate 41*Fr* of the housing 41. The switching mechanism 46 includes a driving pulley 60, a driven pulley 61 which is positioned above the driving pulley 60, a plurality of (five in the present embodiment) supporting pulleys 62 which are arranged between the driving pulley 60 and the driven pulley 61, a driving belt 63 which is wound around the driving pulley 60, the driven pulley 61 and a plurality of the supporting pulleys 62, a pressing member 65 which is fixed to the driving belt 63, and a pair of restricting plates 66 (restricting members; only rear restricting plate 66 is shown in FIG. 3), and a plurality of (five in the present embodiment) coil springs 68 (biasing members) which are positioned at a right side of the driving belt 63.

The driving pulley 60 engages with a lower end part (a first end part in a longitudinal direction) of the driving belt 63. On an outer circumferential face of the driving pulley 60, a driving gear 70 is arranged. The driving pulley 60 is fixed to an outer circumference of a driving shaft 71, and is rotatable in a body with the driving shaft 71. The driving pulley 60 is connected to the driving motor 42 (see FIG. 2) via a second one-way clutch (not shown).

As shown in FIG. 3, the driven pulley 61 engages with an upper end part (a second end part in the longitudinal direction) of the driving belt 63. On an outer circumferential face of the driven pulley 61, a driven gear 73 is arranged. The driven pulley 61 is rotatable around a driven shaft 74.

A plurality of the supporting pulleys 62 are arranged at intervals in the upper and lower direction. Each supporting pulley 62 is rotatable around a supporting shaft 76. A position of each supporting pulley 62 in the upper and lower direction corresponds to that of the pressed piece of each guiding member 45*a* to 45*e*. On an outer circumferential face of each supporting pulley 62, a gear is not arranged.

The driving belt 63 is endless in a circumferential direction. As shown in FIG. 3, in the present embodiment, the upper and lower direction is the longitudinal direction of the driving belt 63, and the front and rear direction is a width direction of the driving belt 63.

On an inner circumferential face of the driving belt 63, and at a whole area in the circumferential direction of the driving belt 63, a belt side gear 75 (only a part of the belt side gear 75 is shown in FIG. 3) is arranged. The belt side gear 75 meshes with the driving gear 70 of the driving pulley 60 and the driven gear 73 of the driven pulley 61. The driving belt 63 is configured to run in accordance with a rotation of the driving pulley 60 so as to move circularly. Incidentally, an arrow X optionally added to each drawing indicates a running direction (circular movement direction) of the driving belt 63.

Figure 4:
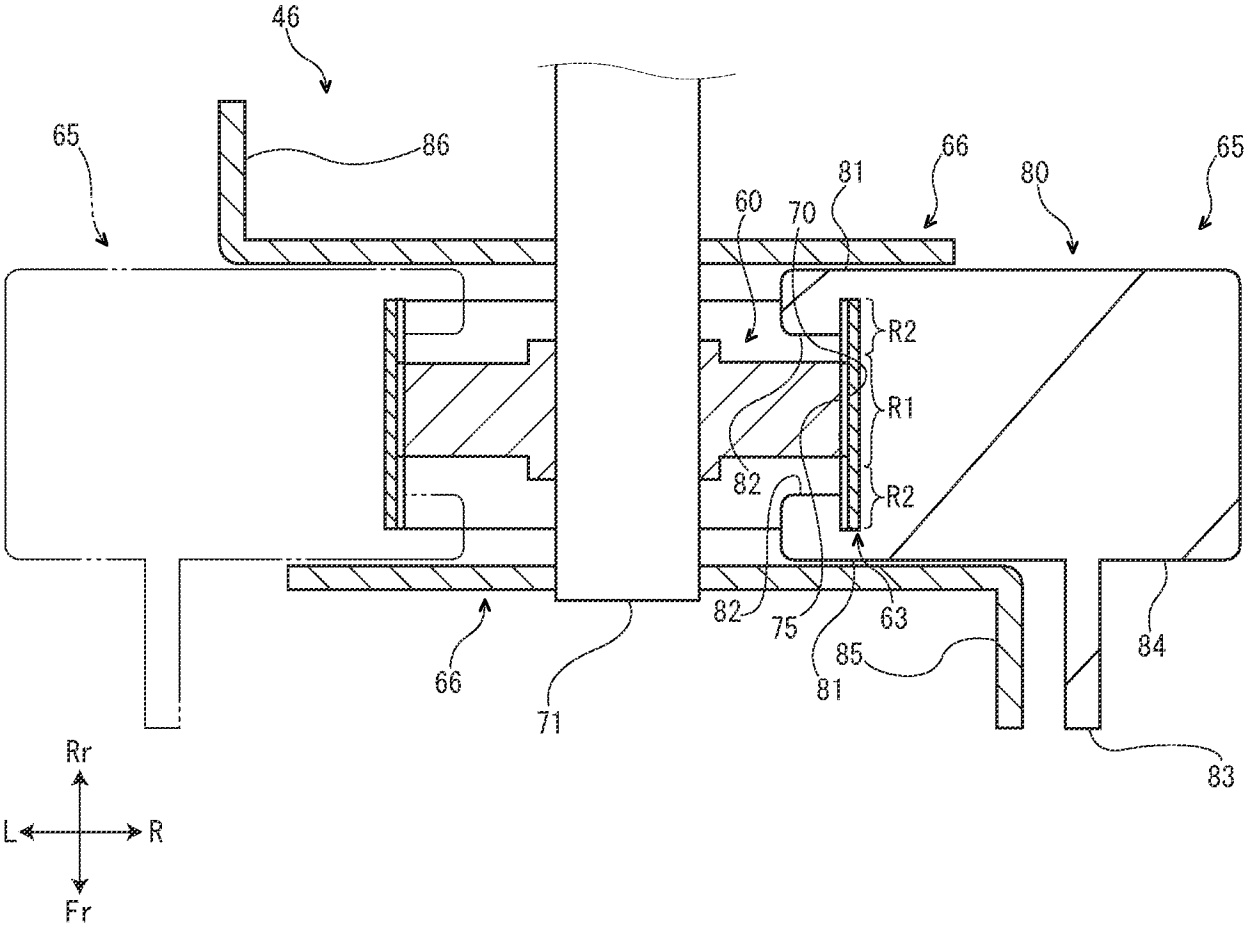
FIG. 4 is a sectional view in a section crossing a driving pulley in the switching mechanism according to the first embodiment of the present disclosure.
Figure 5:
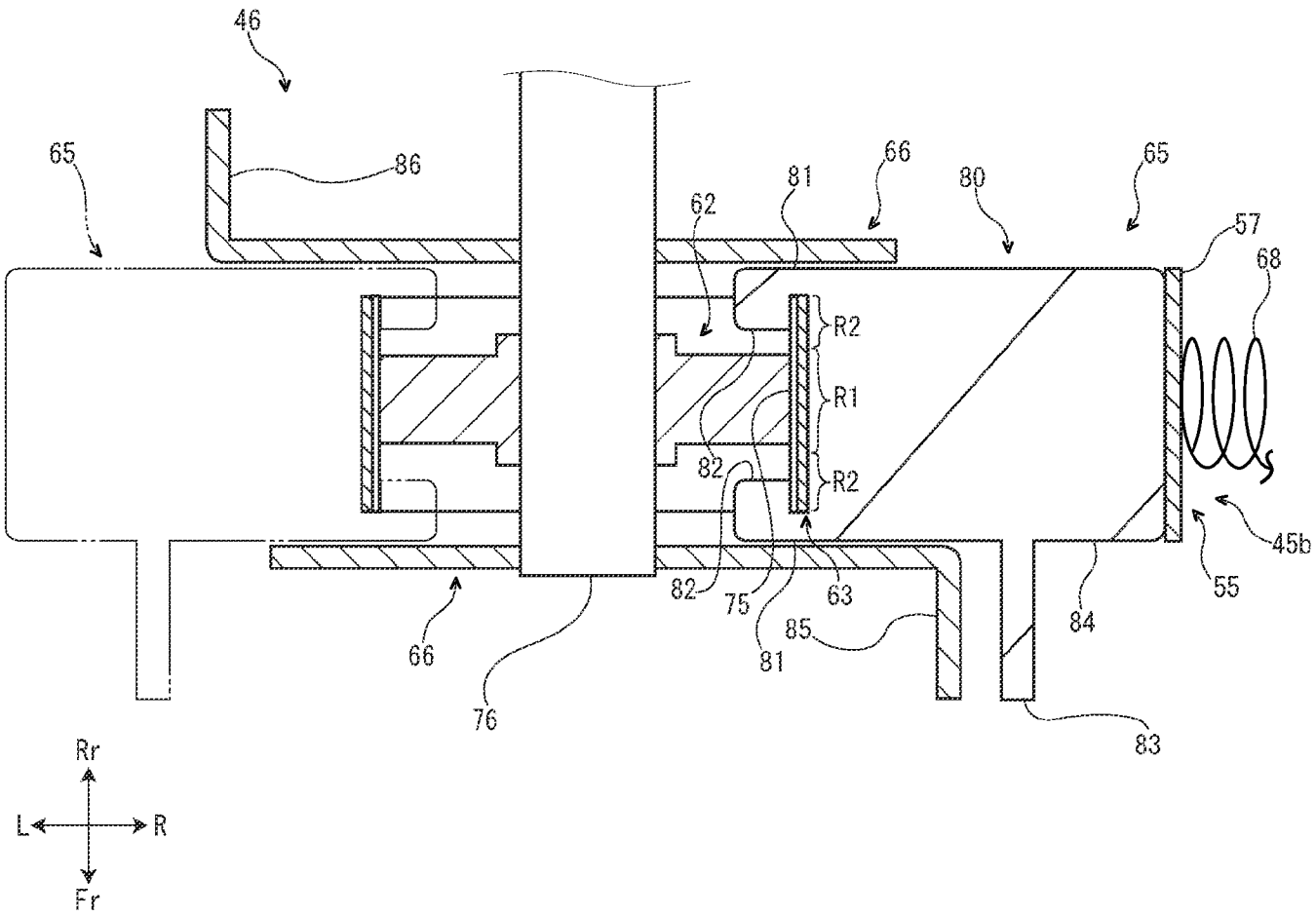
FIG. 5 is a sectional view in a section crossing a supporting pulley in the switching mechanism according to the first embodiment of the present disclosure.

As shown in FIGS. 4 and 5, a front and rear width of the driving belt 63 is wider than a front and rear width of a part, which comes into contact with the driving belt 63, of each pulley 60 to 62 (only the driving pulley 60 is shown in FIG. 4 and only the supporting pulley 62 is shown in FIG. 5). The driving belt 63 includes a contactable area R1 which is contactable with each pulley 60 to 62, and contact restricted areas R2 which are arranged at both outsides of the contactable area R1 in the front and rear direction and whose contact with each pulley 60 to 62 is restricted.

Figure 6:
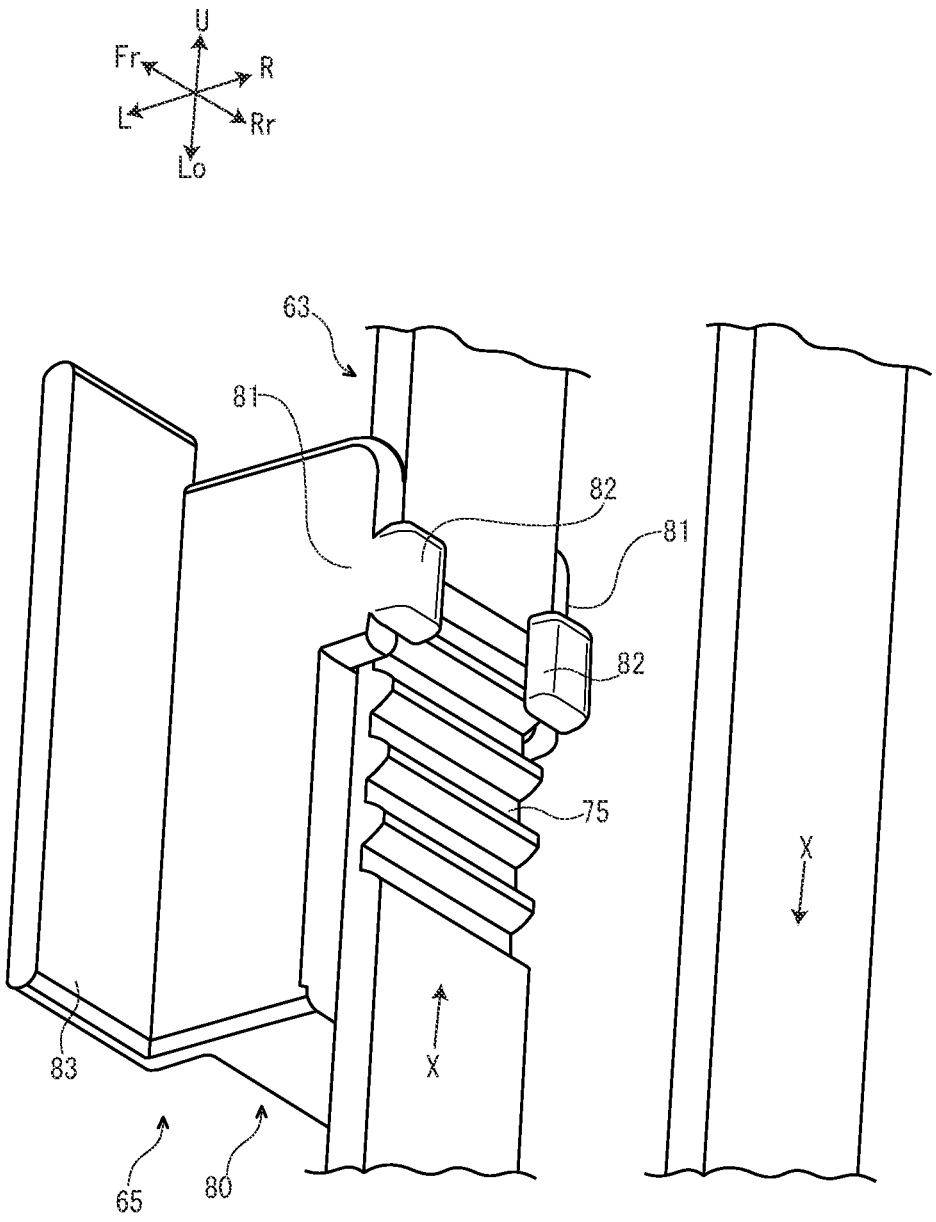
FIG. 6 is a perspective view showing a driving belt and a pressing member in the switching mechanism according to the first embodiment of the present disclosure.

As shown in FIG. 6, the pressing member 65 includes a main body part 80 which is arranged at an outer face side (a left side in FIG. 6) of the driving belt 63, a pair of extending parts 81 which extend from an upstream side part (an upper part in FIG. 6) of the main body part 80 in the running direction of the driving belt 63 toward an inner face side (a right side in FIG. 6) of the driving belt 63, a pair of bent parts 82 which are bent from downstream side part (a lower part in FIG. 6) of each extending part 81 in the running direction of the driving belt 63 toward an inside in the front and rear direction, and a detected part 83 which protrudes forward from a front face of the main body part 80.

As shown in FIG. 3, on an outer face of the main body part 80 of the pressing member 65, a pressing protrusion 84 of a trapezoidal shape seen from a front view is arranged. As shown in FIGS. 4 and 5, an inner face of the main body part 80 comes into contact with outer faces of the contactable area R1 and each contact restricted area R2 of the driving belt 63. The extending parts 81 of the pressing member 65 are arranged at both outsides of the driving belt 63 in the front and rear direction. An outer face of each bent part 82 of the pressing member 65 comes into contact with an inner face of each contact restricted area R2 of the driving belt 63, and does not come into contact with an inner face of the contactable area R1 of the driving belt 63. According to the above-mentioned configuration, the pressing member 65 is fixed to the driving belt 63 in a state that the pressing member 65 directly catches each contact restricted area R2 of the driving belt 63 (corresponding to both front and rear end parts of the entire driving belt 63) from an outer face side and an inner face side.

As shown in FIGS. 2 and 3, each restricting plate 66 is formed in a shape elongated in the upper and lower direction. Each restricting plate 66 is arranged at a whole area in the circumferential direction of the driving belt 63. Between the restricting plates 66, the driving shaft 71, the driven shaft 74 and each supporting shaft 76 are installed.

As shown in FIGS. 4 and 5, each restricting plate 66 restricts movement of the pressing member 65 in the front and rear direction by covering an outside in the front and rear direction of a base end side part (a part directly catching each contact restricted area R2 of the driving belt 63 from an outer face side and an inner face side) of the pressing member 65. At a right end part of the front restricting plate 66, a front bent part 85 bent forward is formed and, at a left end part of the rear restricting plate 66, a rear bent part 86 bent backward is formed.

As shown in FIGS. 2 and 3, a plurality of coil springs 68 are arranged at intervals in the upper and lower direction. Each coil spring 68 is interposed between the contact plate 48 of the housing 41 and the bent plate 57 of the pressed piece 55 of each guiding member 45*a* to 45*e*. Each coil spring 68 biases each guiding member 45*a* to 45*e* to the second posture (the postures of the first guiding member 45*a* and the third to fifth guiding members 45*c* to 45*e* in FIGS. 2 and 3).

Next, an operation of the sheet ejecting device 4 will be described.

When a sheet ejecting operation is performed, the driving motor 42 is rotated in one direction. When the driving motor 42 is rotated in one direction in this way, this rotation is transmitted to the conveying mechanism 43 via the first one-way clutch (not shown), so that the conveying mechanism 43 is activated. According to this, from the lower side to the upper side, each sheet S is conveyed along the third conveying path P3.

Figure 7:
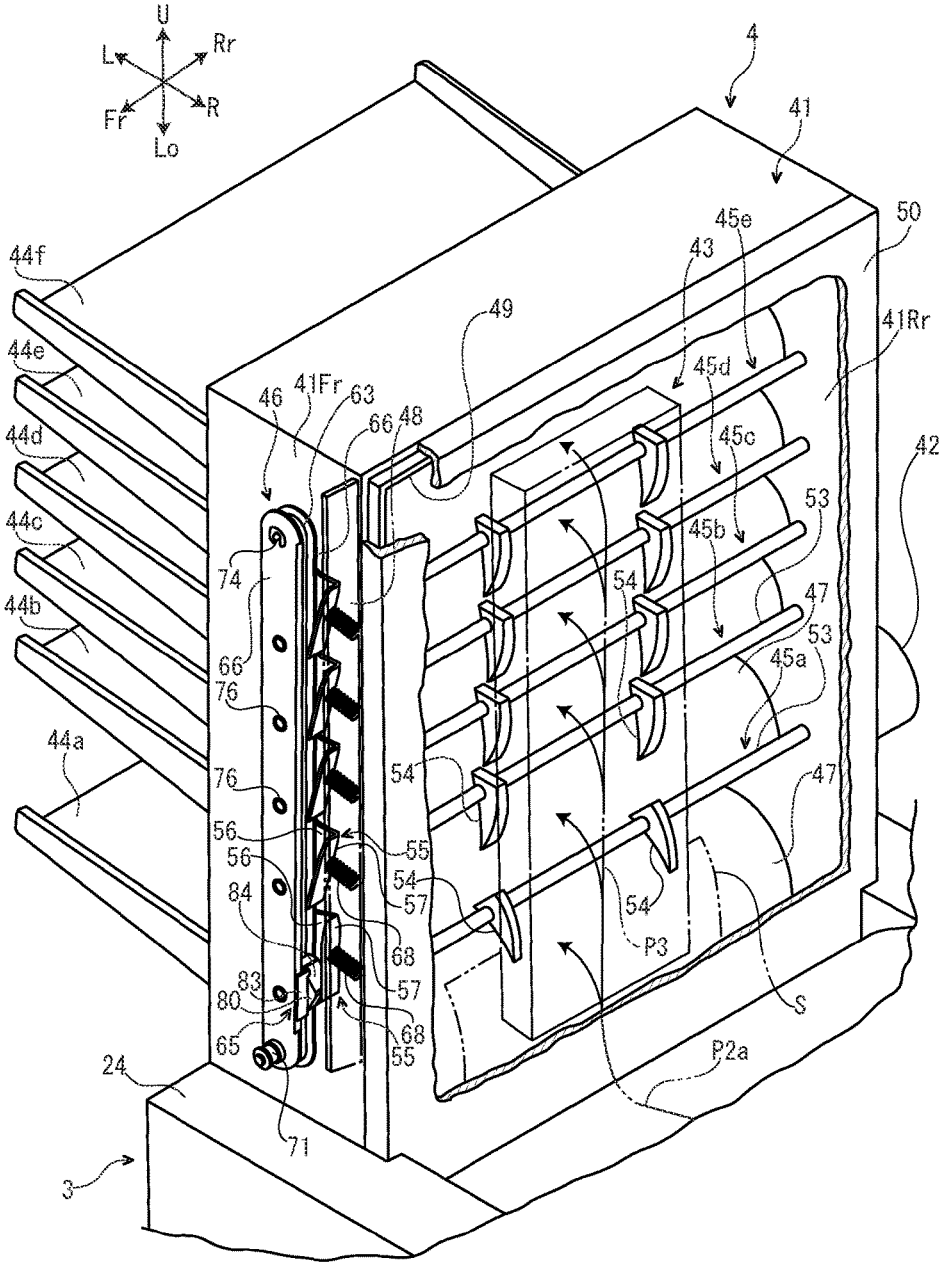
FIG. 7 is a perspective view showing a state where the sheet is ejected on a first ejecting tray in the sheet ejecting device according to the first embodiment of the present disclosure.

FIG. 7 shows a state where the first guiding member 45*a* takes the first posture and the second to fifth guiding members 45*b* to 45*e* take the second posture. In this state, each sheet S conveyed from the lower side to the upper side along the third conveying path P3 is turned to the left side by each guiding piece 54 of the first guiding member 45*a*, and ejected on the first ejecting tray 44*a*.

Meanwhile, FIG. 2 shows a state where the second guiding member 45*b* takes the first posture, and the first guiding member 45*a* and the third to fifth guiding members 45*c* to 45*e* take the second posture. In this state, each sheet S conveyed from the lower side to the upper side along the third conveying path P3 is not turned by each guiding piece 54 of the first guiding member 45*a*, and further conveyed to the upper side. Subsequently, each sheet S is turned to the left side by each guiding piece 54 of the second guiding member 45*b* and ejected on the second ejecting tray 44*b*.

As mentioned above, when the first guiding member 45*a* takes the first posture, ejection of each sheet S on the first ejecting tray 44*a* is permitted and, when the first guiding member 45*a* takes the second posture, the ejection of each sheet S on the first ejecting tray 44*a* is restricted. The same is applied to the second to fifth guiding members 45*b* to 45*e*, and, when the guiding member 45*b* to 45*e* take the first posture, ejection of each sheet S on the second to fifth ejecting trays 44*b* to 44*e* is permitted and, when the second to fifth guiding members 45*b* to 45*e* take the second posture, the ejection of each sheet S on the second to fifth ejecting trays 44*b* to 44*e* is restricted. Incidentally, when all of the first to fifth guiding members 45*a* to 45*e* take the second posture, ejection of each sheet S on the first to fifth ejecting trays 44*a* to 44*e* is restricted and each sheet S is ejected on the sixth ejecting tray 44*f*.

Incidentally, when the driving motor 42 rotates in one direction as mentioned above, a rotation of the driving motor 42 is blocked by the second one-way clutch (not shown) and is not transmitted to the driving pulley 60. Hence, the driving pulley 60 does not rotate, and the driving belt 63 does not run, either.

Meanwhile, when a posture switching operation of each guiding member 45*a* to 45*e* is performed, the driving motor 42 is rotated in a direction opposite to the above-mentioned one direction. When the driving motor 42 rotates in the opposite direction in this way, this rotation is transmitted to the driving pulley 60 via the second one-way clutch (not shown), so that the driving pulley 60 rotates. When the driving pulley 60 rotates in this way, the rotation of the driving pulley 60 is transmitted to the driving belt 63, so that the driving belt 63 runs, and the rotation of the driving pulley 60 is transmitted to the driven pulley 61 via the driving belt 63, so that the driven pulley 61 rotates.

Further, when the driving belt 63 runs as mentioned above, the pressing member 65 fixed to the driving belt 63 moves along the circumferential direction of the driving belt 63. When each sheet S is ejected on the second ejecting tray 44*b*, for example, as shown in FIG. 2, the pressing member 65 is moved to a position corresponding to that of the pressed piece 55 of the second guiding member 45*b*. According to this, the pressing protrusion 84 of the pressing member 65 presses the bent plate 57 of the pressed piece 55 of the second guiding member 45*b*, so that the second guiding member 45*b* is switched from the second posture to the first posture against a biasing force of the coil spring 68. In this situation, as shown in FIG. 5, the supporting pulley 62 supports the contactable area R1 of the driving belt 63 from the inner face side, so that deformation (deflection) of the driving belt 63 toward the inner face side is restricted.

Meanwhile, when a transition from a state where each sheet S is ejected on the second ejecting tray 44*b* to another state where each sheet S is ejected on the first ejecting tray 44*a* is carried out, for example, the driving belt 63 runs, so that the pressing member 65 is moved to the position corresponding to that of the pressed piece 55 of the first guiding member 45*a* as shown in FIG. 7. According to this, the pressing protrusion 84 of the pressing member 65 presses the bent plate 57 of the pressed piece 55 of the first guiding member 45*a*, so that the first guiding member 45*a* is switched from the second posture to the first posture against the biasing force of the coil spring 68. Further, the pressing of the pressing protrusion 84 of the pressing member 65 to the bent plate 57 of the pressed piece 55 of the second guiding member 45*b* is released, and the second guiding member 45*b* is switched from the first posture to the second posture by the biasing force of the coil spring 68. Furthermore, the detected part 83 of the pressing member 65 enters between a light emitting part and a light receiving part of a detecting mechanism (not shown), and the detecting mechanism detects the position of the pressing member 65.

As mentioned above, in the present embodiment, the switching mechanism 46 switches the posture of each guiding member 45*a* to 45*e* between the first posture and the second posture. When the posture of each guiding member 45*a* to 45*e* is switched in this way, the pressing member 65 passes an area corresponding to each pulley 60 to 62, as shown in FIGS. 4 and 5, and a part of each pulley 60 to 62 (only the driving pulley 60 is shown in FIG. 4 and only the supporting pulley 62 is shown in FIG. 5) is inserted inside each bent part 82 of the pressing member 65 in the front and rear direction.

Incidentally, when the driving motor 42 rotates in the opposite direction as mentioned above, the rotation of the driving motor 42 is blocked by the first one-way clutch (not shown) and is not transmitted to the conveying mechanism 43. Hence, the conveying mechanism 43 is not activated and each sheet S is not conveyed.

In the present embodiment, as mentioned above, the pressing member 65 is fixed to the driving belt 63 in the state that the pressing member 65 directly catches each contact restricted area R2 of the driving belt 63 from the outer face side and the inner face side. Consequently, it is possible to suppress an interference of each pulley 60 to 62 and the pressing member 65 without integrally molding the pressing member 65 on the outer face of the driving belt 63. According to this, it is possible to fix the pressing member 65 to the driving belt 63 and to make the driving belt 63 run without making a shape of the driving belt 63 special. Consequently, in some cases, it is also possible to use a reasonable general-use belt for the driving belt 63, thereby reducing manufacturing cost of the sheet ejecting device 4.

Further, the movement of the pressing member 65 in the front and rear direction is restricted by each restricting plate 66. Consequently, it is possible to indirectly restrict movement of the driving belt 63 in the front and rear direction, and stabilize a running track of the driving belt 63.

Further, each restricting plate 66 is arranged at the whole area in the circumferential direction of the driving belt 63 and partially covers the outside of the pressing member 65 in the front and rear direction. Consequently, it is possible to restrict the movement of the driving belt 63 in the front and rear direction, and prevent an inclination of the pressing member 65.

Further, the pressing member 65 includes the main body part 80 which comes into contact with the outer faces of the contactable area R1 and each contact restricted area R2 of the driving belt 63, a pair of extending parts 81 which extend from the main body part 80 and are arranged at both outsides of the driving belt 63 in the front and rear direction, and a pair of bent parts 82 which are bent from each extending part 81 to the inside in the front and rear direction, and come into contact with the inner face of each contact restricted area R2 of the driving belt 63. Consequently, it is possible to reliably fix the pressing member 65 to the driving belt 63.

In the present embodiment, a case where each restricting plate 66 covers the outside of the base end side part of the pressing member 65 in the front and rear direction has been described. In other words, a case where each restricting plate 66 partially covers the outside of the pressing member 65 in the front and rear direction has been described. Meanwhile, in another embodiment, each restricting plate 66 may entirely cover the outside of the pressing member 65 in the front and rear direction.

In the present embodiment, a case where the positioning interval between the first ejecting tray 44*a* and the second ejecting tray 44*b* is wider than the positioning intervals between the ejecting trays 44*b* to 44*f* other than the first ejecting tray 44*a* (e.g. the positioning interval between the second ejecting tray 44*b* and the third ejecting tray 44*c*) has been described. Meanwhile, in another embodiment, positioning intervals between all ejecting trays may be the same.

In the present embodiment, a case where each sheet S is ejected on the first ejecting tray 44*a* of the sheet ejecting device 4 when the first guiding member 45*a* (the guiding member positioned at the uppermost stream side in the conveying direction of the sheets S) takes the first posture has been described. Meanwhile, in another embodiment, each sheet S may be ejected on a tray arranged at the MFP 2 or the post-processing device 3 when the first guiding member 45*a* (the guiding member positioned at the uppermost stream side in the conveying direction of the sheets S) takes the first posture.

In the present embodiment, a case where the sheet ejecting device 4 is coupled to the MFP 2 via the post-processing device 3 has been described. Meanwhile, in another embodiment, the sheet ejecting device 4 may be directly coupled to the MFP 2.

In the present embodiment, a case where the MFP 2 is used as an image forming device for ejecting sheets to the sheet ejecting device 4 has been described. Meanwhile, in another embodiment a mechanism other than the MFP 2, such as a copying machine, a printer or a facsimile, may be used as an image forming device for ejecting sheets to the sheet ejecting device 4.

Second Embodiment

Next, a switching mechanism 90 according to the second embodiment of the present disclosure will be described. Incidentally, components other than restricting plates 91 (restricting member) are the same as those in the first embodiment and therefore will not be described.

Figure 8:
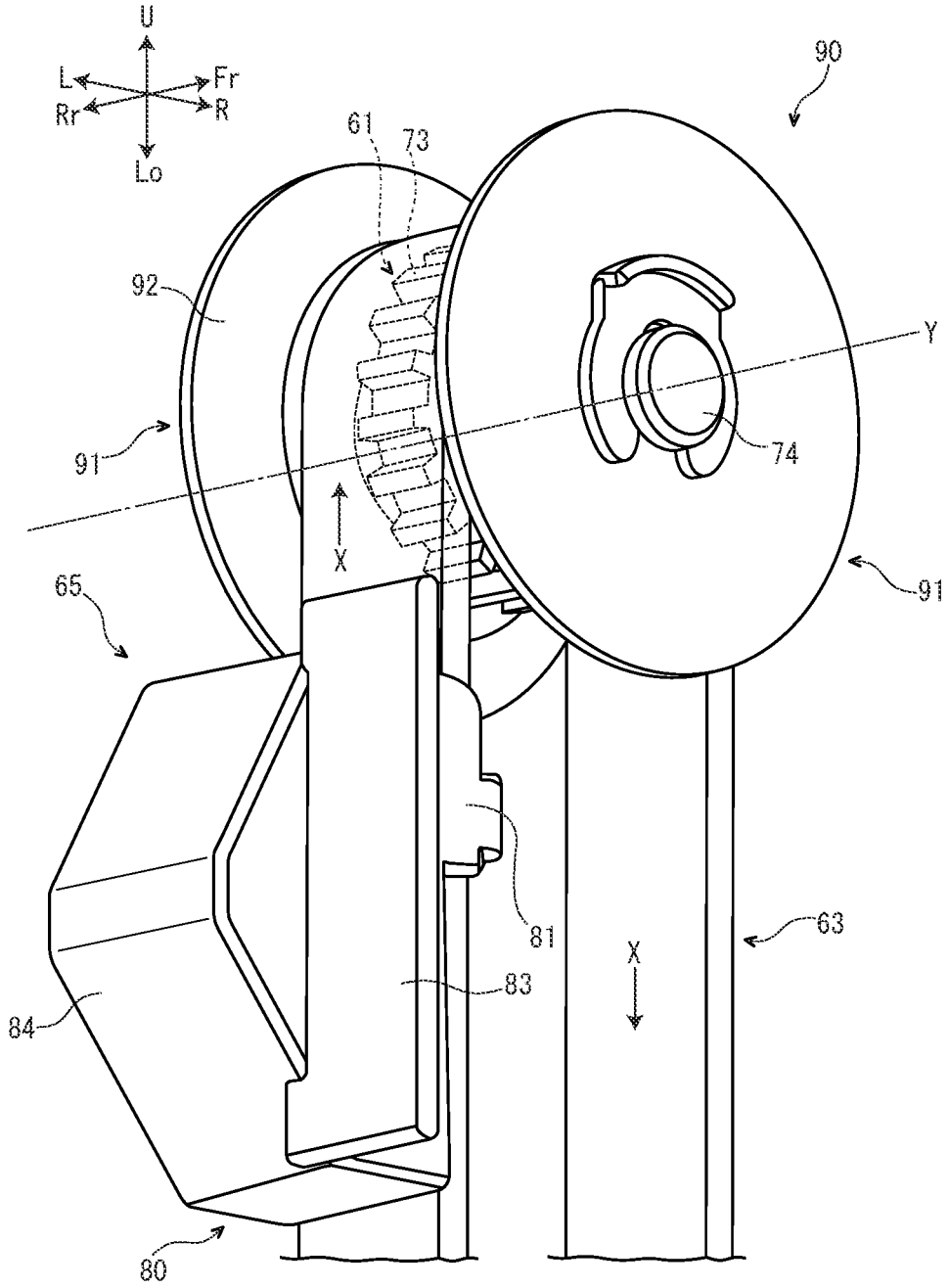
FIG. 8 is a perspective view showing a driven pulley and its periphery in a switching mechanism according to a second embodiment of the present disclosure.
Figure 9:
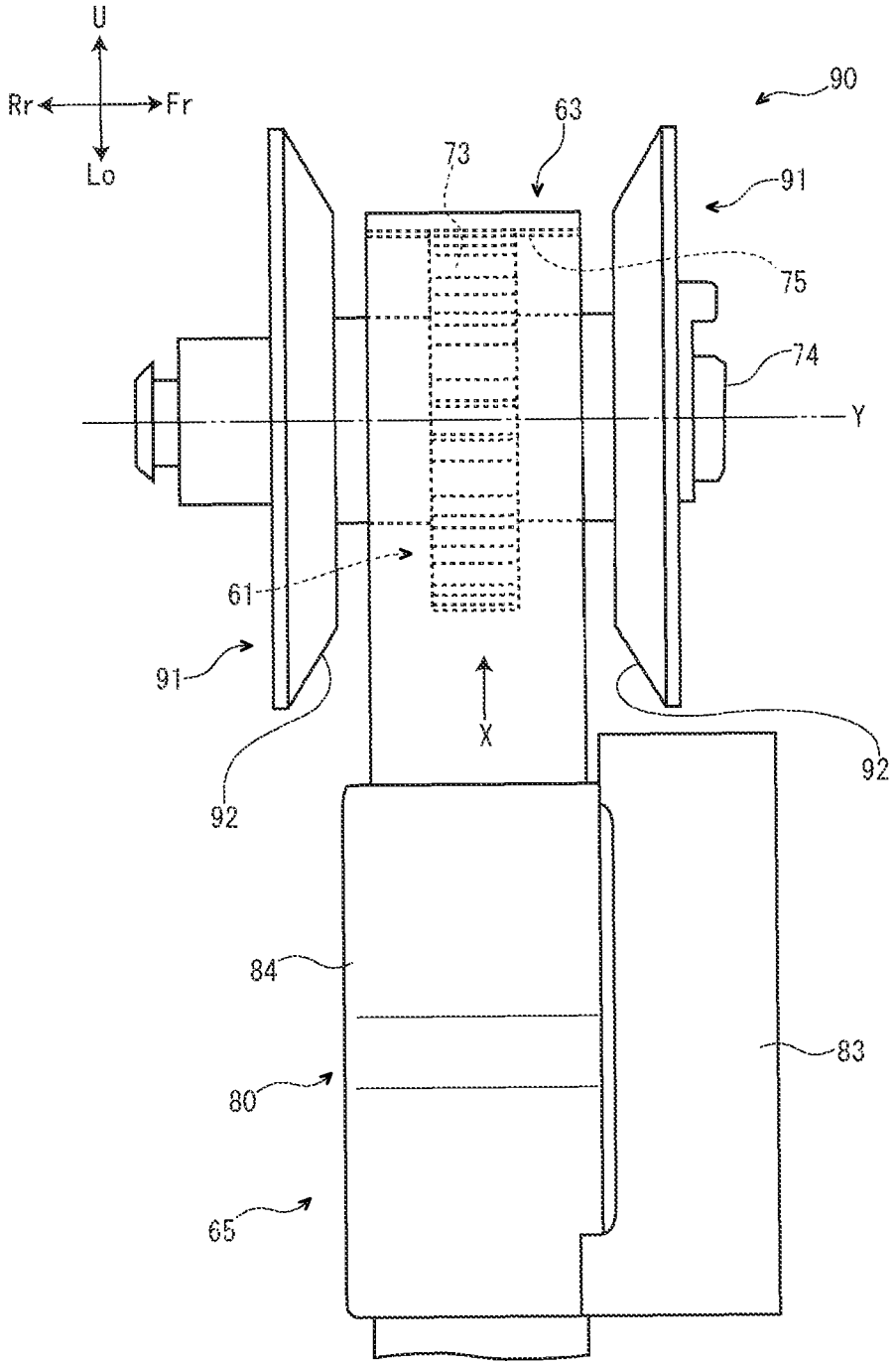
FIG. 9 is a side view showing the driven pulley and its periphery in the switching mechanism according to the second embodiment of the present disclosure.

As shown in FIGS. 8 and 9, each restricting plate is only partially arranged in the circumferential direction of the driving belt 63. Each restricting plate 91 is formed in a disk shape, and each restricting plate 91 and the driven pulley 61 are arranged around the same axial line Y. An outer circumferential region in an inner face of each restricting plate 91 (a region which is contactable with the main body part 80 of the pressing member 65) is provided with an inclined part 92 which is inclined to a side of the axial line Y toward the inside in the front and rear direction.

Incidentally, other restricting plates (not shown) and the driving pulley 60 and each supporting pulley 62 are arranged around the same axial line.

Figure 10:
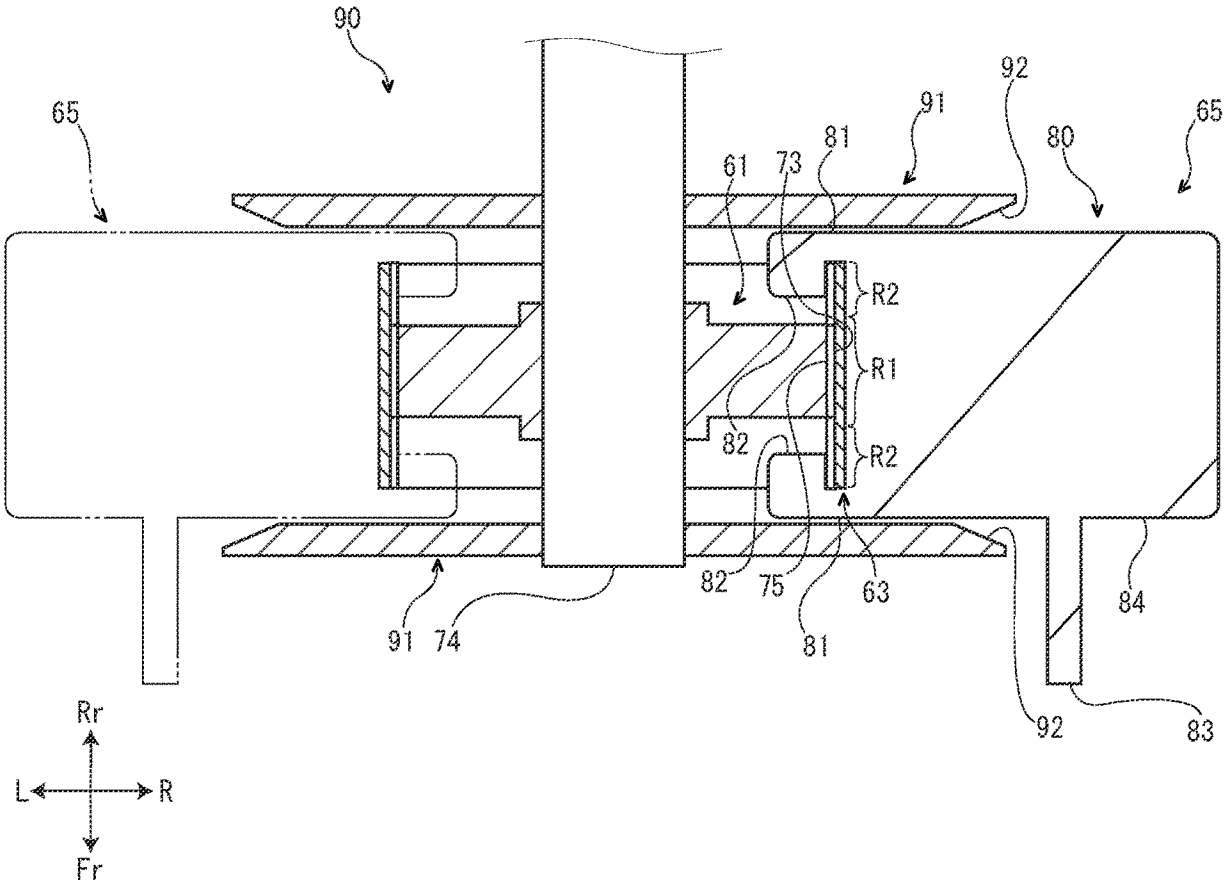
FIG. 10 is a sectional view in a section crossing the driven pulley in the switching mechanism according to the second embodiment of the present disclosure.

In the switching mechanism 90 applying such a configuration, when the pressing member 65 passes an area corresponding to the driven pulley 61 (when the pressing member 65 makes a U-turn along the driven pulley 61), as shown in FIG. 10, the outside of the base end side part (the part directly catching each contact restricted area R2 of the driving belt 63 from the outer face side and the inner face side) of the pressing member 65 in the front and rear direction is covered by each restricting plate 91. Consequently, it is possible to restrict movement of the driving belt 63 in the front and rear direction without making each restricting plate 91 larger.

Figure 11:
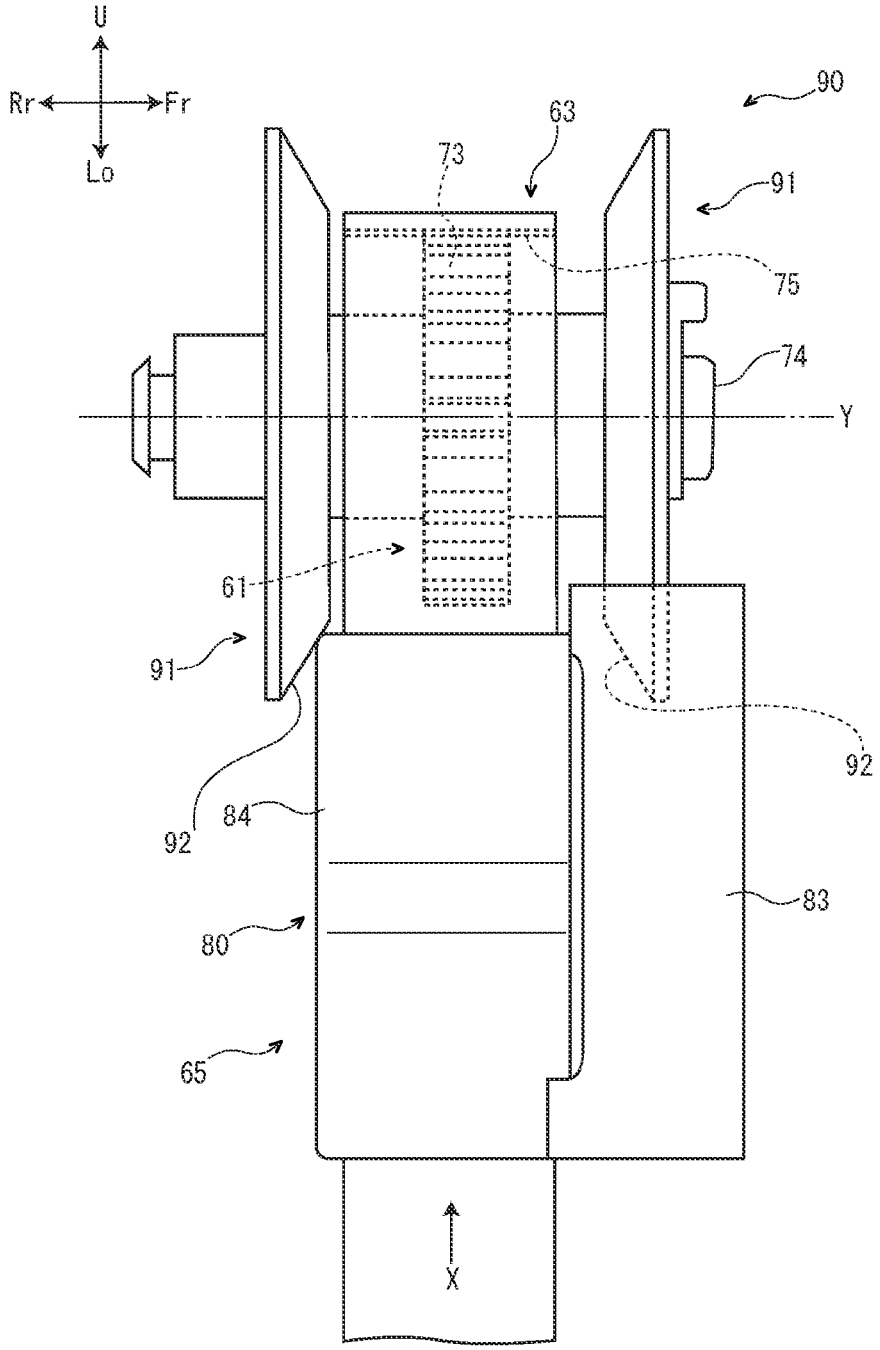
FIG. 11 is a side view showing a state where a main body part of a pressing member comes into contact with an inclined part of a restricting plate in the switching mechanism according to the second embodiment of the present disclosure

Meanwhile, in the present embodiment, each restricting plate 91 is only partially arranged in the circumferential direction of the driving belt 63, and therefore there is a concern that the position of the pressing member 65 is displaced to the front side or the rear side when the pressing member 65 moves through an area which is not provided with each restricting plate 91 (the positioning interval of each pulley 60 to 62). However, in such a case, as shown in FIG. 11, the main body part 80 of the pressing member 65 comes into contact with the inclined part 92 of one of the restricting plate 91 and is guided to the inside in the front and rear direction along the inclined part 92. According to this, it is possible to correct the displaced position of the pressing member 65.

In the present embodiment, a case where the restricting plates 91 are located for all of a plurality of the pulleys 60 to 62 has been described. Meanwhile, in another embodiment, the restricting plates 91 may be located for a part of a plurality of the pulleys 60 to 62. For example, the restricting plates 91 may be located only for the driving pulley 60 and the driven pulley 61 or, on the contrary, the restricting plates 91 may be located only for the supporting pulleys 62.

Figure 12:
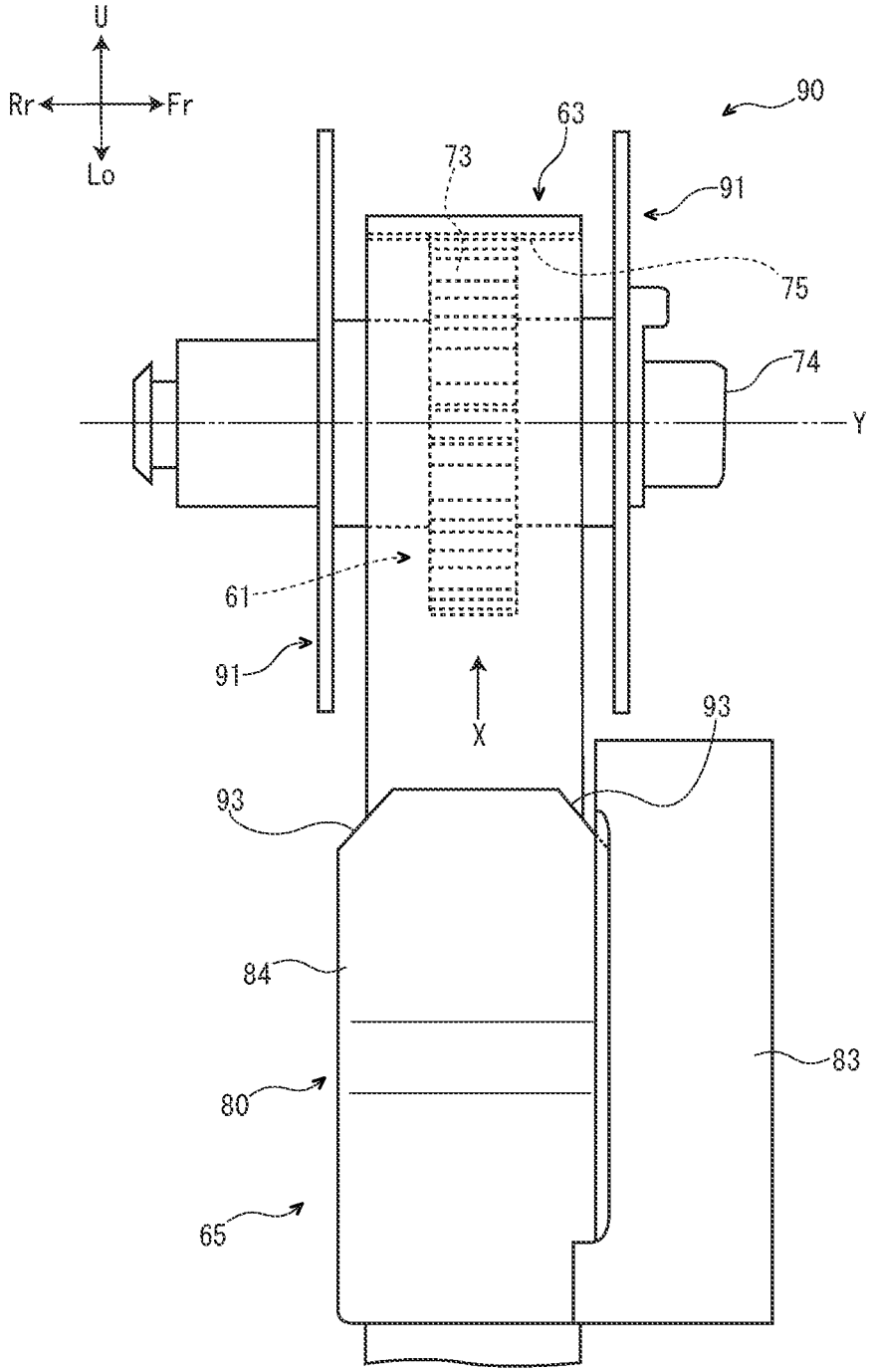
FIG. 12 is a side view showing a driven pulley and its periphery in a switching mechanism according to another embodiment of the present disclosure.

Further, in another embodiment, as shown in FIG. 12, a region, which is contactable with each restricting plate 91, of the main body part 80 of the pressing member 65 may be provided with an inclined face 93 which is inclined to the downstream side in the running direction of the driving belt 63 (the upper side in FIG. 12) toward the inside in the front and rear direction. By applying such a configuration, when the pressing member 65 moves through the area which is not provided with each restricting plate 91, even if the position of the pressing member 65 is displaced to the front side or the rear side, it is possible to correct the displaced position of the pressing member 65 by making each inclined face 93 of the main body part 80 of the pressing member 65 come in contact with each restricting plate 91.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A recording medium ejecting device comprising:

a plurality of ejecting trays on which a recording medium is ejected;

a guiding member configured to be switchable between a first posture to permit ejection of the recording medium on one ejecting tray of the plurality of ejecting trays and a second posture to restrict the ejection of the recording medium on the one ejecting tray; and a switching mechanism configured to switch the guiding member between the first posture and the second posture, wherein the switching mechanism includes;

a plurality of pulleys;

a driving belt wound around the plurality of pulleys; and a pressing member configured to move in accordance with running of the driving belt and to press the guiding member, and the driving belt includes;

a contactable area configured to be contactable with each of the pulleys; and a pair of contact restricted areas whose contact with each of the pulleys is restricted, the pair of contact restricted areas being arranged at both outsides of the contactable area in a width direction of the driving belt, and the pressing member is fixed to the driving belt in a state that the pressing member catches the pair of contact restricted areas from both an outer face side and an inner face side, and the pressing member includes:

a main body part configured to come into contact with outer faces of the contactable area and each of the contact restricted areas;

a pair of extending parts configured to extend from the main body part and arranged at both outsides of the driving belt in the width direction of the driving belt; and a pair of bent parts with each bent part being bent from one of the extending parts toward an inside in the width direction of the driving belt and configured to come into contact with an inner face of one of the contact restricted areas, and a width of an outer circumferential face of each of the pulleys is smaller than a width of the contactable area of the driving belt, and the pressing member further includes a flat plate part which protrudes toward an outside in the width direction of the driving belt from the main body part, wherein a length of each of the extending parts in a running direction of the driving belt is shorter than a length of the main body part in the running direction, and is longer than a length of each of the bent parts in the running direction, wherein the contactable area and the pair of contact restricted areas are provided on a same face of the driving belt, the recording medium ejecting device further comprising a restricting member configured to restrict movement of the pressing member in the width direction of the driving belt, wherein another bent part bent toward the outside in the width direction of the driving belt is formed in one end part of the restricting member, and an outer face of the other bent part faces an inner face of the flat plate part, and wherein the flat plate part is arranged in parallel with a flat part of an outer face of the driving belt.

2. The recording medium ejecting device according to claim 1, wherein the restricting member is arranged at a whole area in a circumferential direction of the driving belt and at least partially covers an outside of the pressing member in the width direction of the driving belt.

3. The recording medium ejecting device according to claim 1, wherein the plurality of pulleys include:

a driving pulley engaged with a first end part in a longitudinal direction of the driving belt;

a driven pulley engaged with a second end part in the longitudinal direction of the driving belt; and a supporting pulley arranged between the driving pulley and the driven pulley.

4. The recording medium ejecting device according to claim 3, wherein a driving gear is arranged on an outer circumferential face of the driving pulley, and a driven gear is arranged on an outer circumferential face of the driven pulley, and a belt side gear meshed with the driving gear and the driven gear is arranged on an inner circumferential face of the driving belt.

5. The recording medium ejecting device according to claim 3, wherein a position of the supporting pulley in the longitudinal direction of the driving belt corresponds to that of the guiding member in the longitudinal direction of the driving belt.

6. An image forming apparatus comprising the recording medium ejecting device according to claim 1.

* * * * *